US008167419B2

(12) United States Patent
Yamamoto

(10) Patent No.: US 8,167,419 B2
(45) Date of Patent: May 1, 2012

(54) INK JET RECORDING HEAD AND INK JET RECORDING APPARATUS

(75) Inventor: Shinji Yamamoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 510 days.

(21) Appl. No.: 12/194,837

(22) Filed: Aug. 20, 2008

(65) Prior Publication Data

US 2009/0219334 A1 Sep. 3, 2009

(30) Foreign Application Priority Data

Aug. 24, 2007 (JP) ..... 2007-218216

(51) Int. Cl.
*B41J 2/175* (2006.01)

(52) U.S. Cl. ..... 347/93

(58) Field of Classification Search ..... None
See application file for complete search history.

(56) References Cited

U.S. PATENT DOCUMENTS 5,699,095 A * 12/1997 Mitsuzawa et al. ..... 347/92
6,217,164 B1 * 4/2001 Hino ..... 347/85
6,244,697 B1 * 6/2001 Powers et al. ..... 347/93
6,253,775 B1 * 7/2001 Kitahara et al. ..... 134/108
6,290,323 B1 * 9/2001 Sharma et al. ..... 347/28
7,249,833 B2 * 7/2007 Silverbrook et al. ..... 347/86

FOREIGN PATENT DOCUMENTS

JP 2001-162838 6/2001

* cited by examiner

*Primary Examiner* — Julian Huffman
*Assistant Examiner* — Alexander C Witkowski
(74) *Attorney, Agent, or Firm* — Fitzpatrick, Cella, Harper & Scinto

(57) ABSTRACT

An ink jet recording head includes a plurality of ink jet head substrates each including ejection outlets for ejecting ink and energy generating elements for generating energy for ejecting the ink; a supporting substrate for supporting the plurality of ink jet head substrates; an ink accommodating portion for accommodating the ink; and a filter provided at a communicating portion between the plurality of ink jet head substrates and the ink accommodating portion so as to be inclined with respect to gravitational direction. At a highest position of the filter with respect to gravitational direction, a suction opening through which the ink in the plurality of ink jet head substrates is capable of being sucked is provided.

4 Claims, 7 Drawing Sheets

INK JET RECORDING HEAD AND INK JET RECORDING APPARATUS

FIELD OF THE INVENTION AND RELATED ART

The present invention relates to an ink jet recording head for performing a recording operation by ejecting liquid such as ink or the like and an ink jet recording apparatus including the ink jet recording head.

An embodiment of a structure of a conventional full-line type ink jet recording head is shown in FIG. 7.

The ink jet recording head includes a container portion 607, an ink jet recording head 601, a supporting substrate 602, a filter 605, and a filter plate 604. In the container portion 607, a predetermined amount of ink 606 is stored. The ink jet head substrate 601 includes a plurality of connected ink ejection outlets 604*ai* and 604*bi* for ejecting the ink 606 stored in the container portion 607 and ink from the container portion 607. The supporting substrate 602 supports the ink jet head substrate 601.

The ink jet head substrate 601 includes heaters 613*ai* and 614*bi* (i=1 to N where N is an integer) as ejection energy generating means opposing the connected ink ejection outlets 604*ai* and 604*bi*, respectively.

Such an ink jet recording head is connected to an ink containing portion for supplying ink to its ink accommodating portion with a predetermined difference in height so that an inside pressure of the ink accommodating portion is a predetermined negative pressure.

The ink jet recording apparatus includes a recording head having a plurality of ejection outlets (nozzles) for ejecting ink (hereinafter referred to as an "ink jet recording head"). When the ejection outlets are clogged, normal recording cannot be carried out.

Ejection defect (failure) by the clogging or the like of the ejection outlet portion can be caused due to the following factors.

For example, the ejection defect can be caused by impurities such as fine dust, from an ink supplying system, entering an ink supply passage in the case where an ink accommodating portion for accommodating ink or minute pieces of a porous member used as an ink holding member is replaced. Further, the ejection defect can also be caused in the case where dust generated from a recording medium or the like is directly deposited at the ejection outlet portion.

Inside the ink jet recording head, ink passing through a filter for removing contaminant provided at a position corresponding to each of ink jet head substrates is filtered through the filter which does not permit passing of dust or the like having a diameter of, e.g., 10 μm or more. By this filter, the dust in the ink does not enter a portion inside the filter.

Therefore, it is important that means for removing the dust in the ink is provided in a path from the ink accommodating portion to the ejection outlets in the ink jet recording apparatus. A most popular method as the means is such that a filter is disposed in the ink supply passage to subject the ink to filtration.

As shown in FIG. 7, the filter 605 and the filter plate 604 separate a storing portion for storing the ink 606 and the ink in a common liquid chamber 609 communicating with the ink jet head substrate 601. As a result, the ink 606 in the container portion 607 is separated from the ink in the common liquid chamber 609 by the filter 605. In other words, the ink 606 in the container portion is constituted so as to be always supplied to the common liquid chamber 609 through the filter.

The ink supplied to the common liquid chamber 609 is supplied into the ink jet head substrate 601. In the case of employing the above-described filter, bubbles generated from dissolved air in the ink in the ink supply passage by an environmental change or the like such as a head temperature rise gather at the filter portion. When this state is left standing during recording in the case where the bubbles gather at the filter portion, there is a possibility of deterioration of recording quality or the like due to bubble expansion by the head temperature rise.

Thus, the ink jet recording apparatus is accompanied with a problem of a lowering in recording quality due to bubbles remaining inside the filter. Further, the lowering in recording quality is also caused due to the case where the ink cannot be ejected at an ordinary ejection pressure due to an increase in ink viscosity by vaporization of an ink solvent in the neighborhood of the ejection outlets, e.g., when the ink jet recording apparatus is not used for a long time or caused due to clogging of the ejection outlet portion with externally deposited impurities or the like.

In order to solve these problems, such a refreshing process that the ink is subjected to sucking from the ejection outlets for ejecting the ink to suck the bubbles from the inside of the recording head to the outside of the recording head has been conventionally used.

In a conventional serial type printer, in the case where the ejection outlet portion is clogged with impurities or minute bubbles are present in a common liquid chamber or the like, the refreshing process for subjecting the ink to sucking from the ejection outlets has been carried out. By performing the refreshing process for sucking the impurities and/or the bubbles from the inside to the outside of the recording head, clogging has been eliminated and the minute bubbles have been removed, thus preventing an influence on ejection accuracy.

Generally, as a refreshing operation in a serial type ink jet recording apparatus for effecting recording by movement of a carriage having thereon the ink jet recording head by a driving motor, the following two methods can be used. A first method is a method in which a suction cap is externally brought into intimate contact with an ink jet head substrate to externally remove bubbles by a suction pump or the like. A second method is a method in which a recording head is refreshed by rotating a tube pump connected to an ink supplying pipe to internally pressurize the recording head.

Similarly, with respect to a full-line type ink jet printer, these two methods can be used for the refreshing process.

With respect to the full-line type ink jet printer, Japanese Laid-Open Patent Application (JP-A) 2001-162838 discloses a refreshing method in which a suction cap is externally brought into intimate contact with an ink jet head substrate to carry out external suction. An example of such a suction refreshing method will be described with reference to FIG. 8. First, a suction cap 720 is brought into intimate contact with an ink jet head substrate 701 of an elongated ink jet recording head 710. Thereafter, by rotating a tube pump 730, bubbles B present inside of a common liquid chamber 709 and a filter plate 704 are removed.

Then, a pressurizing refreshing operation in the full-line type ink jet printer will be described with reference to FIG. 9.

A tube 831 is connected to an ink removing pipe 808 at an end portion of a recording head 810 through an openable valve, thus communicating with a common liquid chamber 809 of the recording head 810. In order to remove bubbles generated during initial ink filling or a recording operation on a recording medium, a head refreshing operation is performed in a state in which the openable valve is closed for a predetermined time while the ink is circulated between an ink accommodating portion and the recording head 810 by a pump 830.

By such an operation, an inside pressure of the recording head 810 is increased instantaneously, so that the ink is ejected from an ink ejection outlet array. At the same time, bubbles present inside the common liquid chamber 809 and the filter plate 804 and bubbles B remaining in an ink jet head substrate 801 are discharged from the ink jet head substrate 801 along with flow of the ink.

However, in the elongated ink jet recording head, the above-described suction refreshing method performed externally for each of the ink jet head substrates requires suction refreshing caps in number corresponding to the number of the ink jet head substrates. Or, the suction refreshing method requires individual suction refreshing for each of the ink jet head substrates by moving the suction refreshing cap in a longitudinal direction of the ink jet recording head by a driving source such as a motor. Or, it is necessary to prepare a single large cap to effect suction refreshing of the entire recording head.

However, such a suction refreshing operation from below the recording head in the elongated ink jet printer is difficult from the viewpoints of close-contactness of the cap increased in contact area, a uniform refreshing performance in the entire nozzle area, and the like. Further, when the close-contactness of the capping is enhanced, a capping pressure is increased, thus resulting in an increase in load on the recording head. This leads to an increase in burden on the head structure, thus being disadvantageous for cost, reliability, etc.

As shown in FIG. 9, in the full-line type ink jet recording head, the ink pressurizing pipe 808 and an ink removing pipe 810 are disposed at end portions thereof. For this reason, in the pressurizing refreshing method in which pressure is applied through the ink pressurizing pipe 808, a pressure applied to a filter surface at a position close to the ink removing pipe 810 is lower than that applied to the filter surface at a position close to the ink pressurizing pipe 808.

A bubble B1 is a bubble present inside the common liquid chamber 809 and the filter plate 804 located in the neighborhood of the ink removing pipe 810. Further, a bubble B is a bubble present inside the common liquid chamber 809 and the filter plate 804 located in the neighborhood of the ink pressurizing pipe 808. In such a constitution of the elongated ink jet recording head, when the pressurizing refreshing operation is performed, a bubble removing performance of the bubble B1 is lower than that of the bubble B.

Further, in an elongated printer having a recording width corresponding to a recording medium, it is very difficult to apply a sufficient pressure in order to remove bubbles at a portion inside of the filter. For this reason, there is a high possibility that the bubbles remain the portion inside of the filter without being removed after the recording head is refreshed by the pressurizing refreshing process.

Therefore, in the filter plate, the bubbles are not readily removed, so that the recording head has to effect a recording operation with the remaining bubbles. When an amount of the bubbles remaining in the filter plate is increased, there is a possibility that temperature rise of the ink jet head substrate, a lowering in cooling efficiency during ink circulation, and bubble expansion during the temperature rise adversely affect recording.

SUMMARY OF THE INVENTION

A principal object of the present invention is to provide an ink jet recording head capable of reliably removing bubbles at an inside portion of a filter.

Another object of the present invention is to provide a bubble removing method capable of removing the bubble at the inside portion of the filter.

According to an aspect of the present invention, there is provided an ink jet recording head comprising:

a plurality of ink jet head substrates each including ejection outlets for ejecting ink and energy generating elements for generating energy for ejecting the ink;

a supporting substrate for supporting the plurality of ink jet head substrates;

an ink accommodating portion for accommodating the ink; and a filter provided at a communicating portion between the plurality of ink jet head substrates and the ink accommodating portion so as to be inclined with respect to gravitational direction;

wherein at a highest position of the filter with respect to gravitational direction, a suction opening through which the ink in the plurality of ink jet head substrates is capable of being sucked is provided.

According to the present invention, it is possible to remove the bubbles at the inside portion of the filter with reliability.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, embodiments of the present invention will be described.

First, a general structure of a full-line type printer to which the present invention is applicable will be described.

Figure 1:
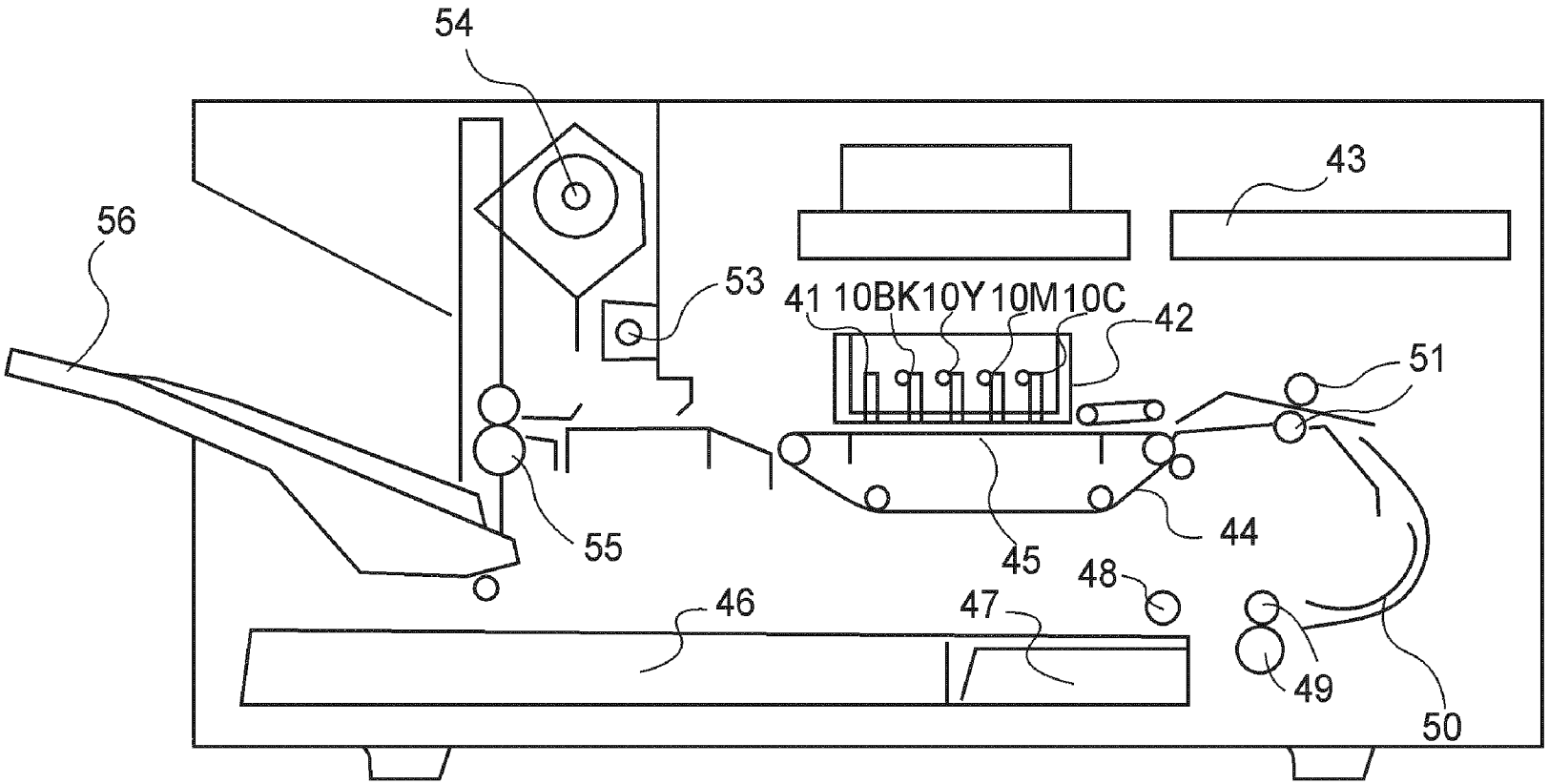
FIG. 1 is a schematic view of an ink jet printer to which the ink jet recording head according to the present invention is applicable.

Referring to FIG. 1, ink jet recording head 10Bk, 10Y, 10M and 10C corresponding to ink colors of black, yellow, magenta and cyan, respectively, are fixed to a block 42. Each of the recording heads includes an electro-thermal transducer as an ejection energy generating means and ejects ink droplets from ejection outlets with bubbles, as a pressure source, generated in the ink during energization thereof.

Further, to the block 42, a reading head 41 for detecting the number of ejection outlets which are subjected to and not subjected to ejection is provided.

During non-recording such as stand-by, the block 42 is raised to a predetermined position, so that the ink jet recording heads 10Bk to 10C are disposed oppositely to a capping unit 43 and capped with the capping unit 43.

The capping unit 43 also functions as a receiving vessel for receiving residual ink which is supplied through a refreshing pump and an ink supplying system (both not shown) during circulation and refreshing and ejected from the ejection outlets. The residual ink is guided into an unshown residual ink accommodating portion.

An endless electrostatic attraction belt 44 conveys a recording sheet so as to oppose each of the ink jet recording heads 10Bk, 10Y, 10M and 10C with a predetermined spacing. A back platen 45 is disposed oppositely to the respective ink jet recording heads through the electrostatic attraction belt 44.

A sheet feeding cassette 46 accommodates a recording sheet 47 such as plain paper and is detachably mountable to an apparatus main assembly.

A pick-up roller 48 picks up and feeds only an uppermost recording sheet 47.

Feeding rollers 49 and 51 are rollers for feeding and conveying the recording sheet 47. The feeding rollers 49 are provided on an entrance side of a feeding path 50 and the feeding rollers 51 are provided on an exit side of the feeding path 50. The recording sheet 47 is picked up by the pick-up roller 48 and fed to the feeding path 50 by the feeding rollers 49.

A heater 53 and a fan 54 dry and fix ink droplets adhered to the recording sheet by heated air during recording.

Discharging rollers 55 are rollers for discharging the recording sheet 47 subjected to the fixation to the outside of the apparatus and the discharged recording sheet 47 is successively stacked on a tray 56.

Next, an operation of the above-constituted apparatus (printer) will be described.

First, a recording operation will be described.

When scanning of recording start is performed, a recording sheet 47 of a designated size is picked up from the sheet feeding cassette 46 by the pick-up roller 48. The picked-up recording sheet 47 is rotated in a state of being electrically charged in advance by the feeding rollers 49 and 51 and is placed on the electrostatic attraction belt 44 which has a planar shape by the back platen 45. In interrelation with reaching of a leading end of the recording sheet 47 to a lower portion of each of the heads 10C, 10M, 10Y and 10Bk, the electro-thermal transducer of each recording head is driven depending on image data. By this drive, an ink droplet depending on image information is ejected from an ejection outlet toward the surface of the recording sheet 47, so that recording is effected by placement of the ink droplet.

In the case where the recording sheet 47 has low hygroscopicity, the ink droplet adhered to the surface of the recording sheet 47 is not dried to cause recording sheet contamination by rubbing. For this reason, the recording sheet 47 is forcedly dried by the heater 53 and the fan 54, so that the ink is fixed on the recording sheet 47. After the fixation, the recording sheet 47 is discharged onto the tray 56 by the discharging rollers 55.

As described above, by supplying a recording signal to each of the ink jet recording heads corresponding to the inks of cyan, magenta, yellow and black, a color image is formed.

Figure 2:
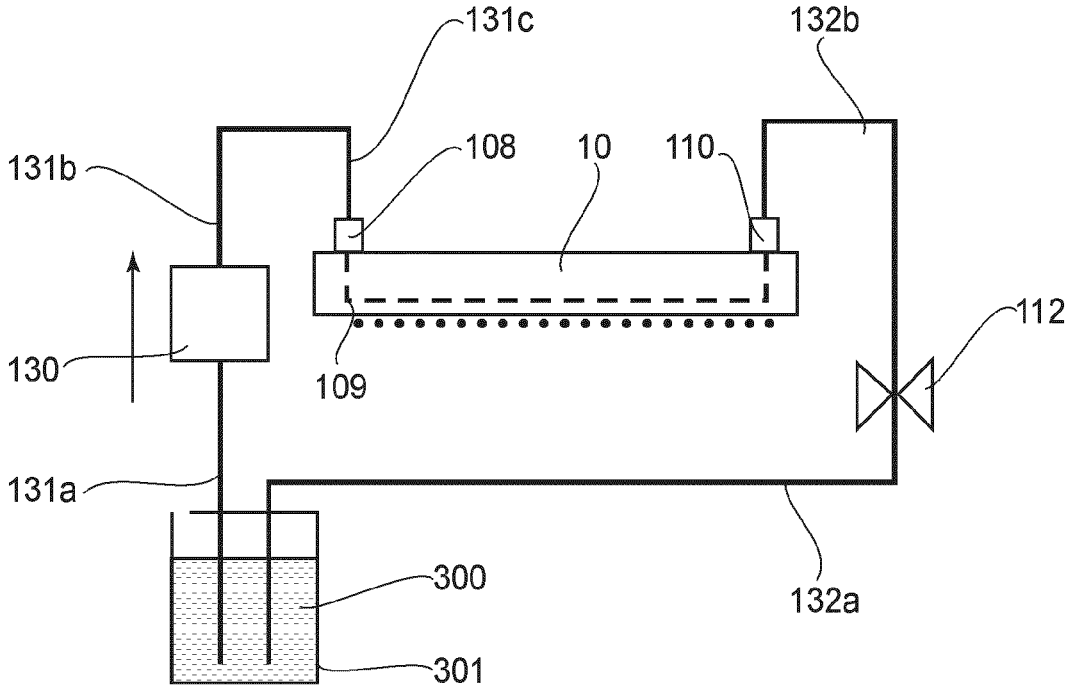
FIG. 2 is a schematic view for illustrating an ink supplying system of an ink jet recording apparatus provided with a dust removing device.

FIG. 2 is a schematic view for illustrating an ink supplying system of an ink jet recording apparatus provided with a dust (contamination) removing device.

The ink supplying system of the ink jet recording apparatus, as shown in FIG. 2, includes an ink containing portion 301 containing ink 300 and in the ink containing portion 301, two tubes 131 and 132 are provided. Of these tubes, the tube 131 is connected to a ink pressurizing pipe 108 at one end portion of an ink jet recording head 10 through a pump 130 and communicates with an inside of a common liquid chamber 109. On the other hand, the other tube 132 is connected to an ink removing pipe 110 at the other end portion of the ink jet recording head 10 through an openable valve 112 and communicates with the common liquid chamber 109.

In the case where the ink 300 is supplied from the ink containing portion 301 to the ink jet recording head 10 through the tube 131 during the recording, the openable valve 112 is opened and the ink is supplied through the ink pressurizing pipe 108 by a capillary force or the like of the ink jet recording head 10 and the tube 131 with respect to the ink.

The ink jet recording head 10 includes a plurality of ink ejection outlets from which ink droplets are ejected by a recording head driving circuit (not shown) during the recording.

First Embodiment

Figure 3:
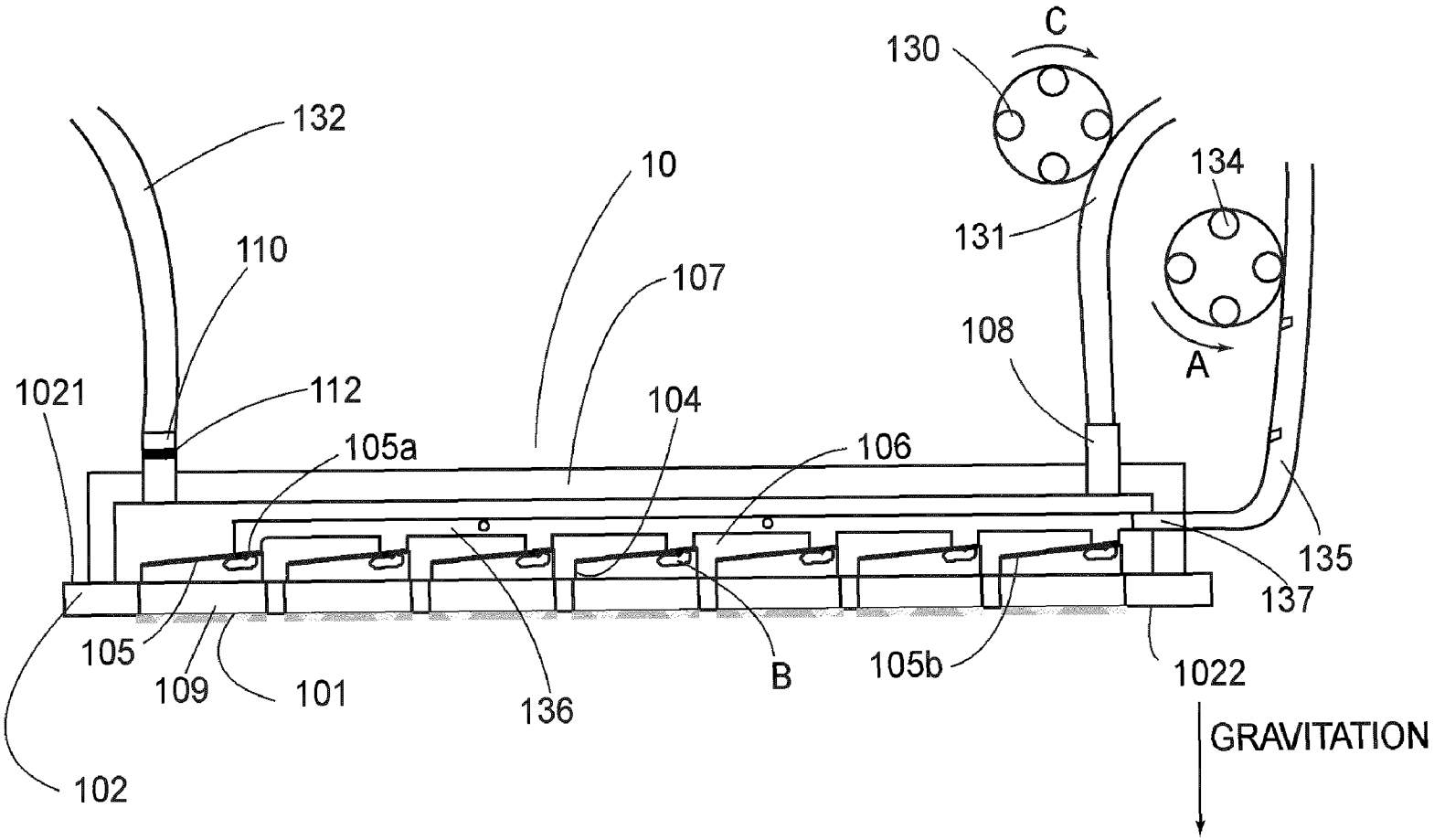
FIGS. 3 to 6 are schematic sectional views of ink jet recording heads in First Embodiment to Fourth Embodiment, respectively, of the present invention.

Next, a schematic sectional view of an ink jet recording head of this embodiment according to the present invention used in the above-described ink jet recording head is shown in FIG. 3.

The ink jet recording head 10 includes a chip container 107, as an ink accommodating portion for accommodating ink, in which ink 106 is filled. The ink jet recording head 10 further includes a supporting substrate 102 including a plurality of ink jet head substrates 101 arranged in a nozzle arrangement direction. The ink jet head substrates 101 are provided with a plurality of nozzles for ejecting the ink and a plurality of ejection energy generating elements for generating ejection energy. Further, to the supporting substrate 102, a common liquid chamber 109 through which the ink flows into the ink jet head substrate 101 is provided.

On a surface 1021 of the supporting substrate 102 opposite through the common liquid chamber 109 from the surface on which the ink jet head substrate 101 is provided, a filter plate 104 is provided so as to oppose each of the common liquid chambers 109. On the filter plate 104, a filter 105 is disposed in an inclined state. That is, the filter 105 is inclined with respect to a gravitational direction (indicated by a downward arrow in FIG. 3) in order to collect a bubble floating against gravitation at a predetermined position.

The filter 105 is provided to a communicating portion between the chip container 108 and the ink jet head substrate 101 and prevents dust or the like in the chip container 107 from entering a nozzle provided to the ink jet head substrate 101.

At an upper end portion of the surface of the inclined filter 105, a filter inside bubble removing pipe 136 is provided in intimate contact with the filter 105 through a suction opening. From the suction opening, the ink is capable of being externally sucked. The filter inside bubble removing pipe 136 communicates with all of inside portions of the filters 105, so that all the filters 105 communicate with a bubble sucking tube 135 through the suction openings. To the bubble sucking tube 135, a bubble sucking tube pump 134 is connected.

To both end portions of the ink jet recording head 10, an ink pressurizing pipe 108 and an ink removing pipe 110 is provided. To the ink pressurizing pipe 108 and the ink removing pipe 110, tubes 131 and 132 are connected, respectively. A tube pump 130 is connected to the ink pressurizing pipe 108 and an openable valve 112 is provided to the ink removing pipe 110. When a recording operation is carried out, the openable valve 112 disposed inside the ink jet recording head 10 is opened to place and keep the inside of the ink jet recording head in a state in which the inside pressure is a negative pressure lower than ambient pressure. The tube pump 130 connected to the ink pressurizing pipe 108 is not actuated ordinarily during the recording but can be required to be rotated during the recording when cooling is performed by circulating the ink in order to suppress an increase in temperature of the ink jet recording head 10.

A bubble removing method in the above-constituted full-line type ink jet recording head 10 in this embodiment will be described.

During initial filling of the ink or during a continuous recording operation, a bubble B remains in the common liquid chamber 109 and the filter plate 104.

In this embodiment, the filter 105 is inclined with respect to the gravitational direction, so that the bubble in the common liquid chamber 109 can be collected concentratedly to a part of the filter 105. That is, the remaining bubble B is held at the upper end portion 105*a* in contact with a filter surface 105*b* by buoyancy.

When a refreshing operation for refreshing an ejection performance of the ink jet recording head 10 is carried out, the bubble attraction tube pump 134 is rotated in a direction of an arrow A shown in FIG. 3.

At the same time when the rotation of the bubble attraction tube pump 134 is started, the inside pressure of the bubble attraction tube 135 is a negative pressure. The bubble attraction tube 135 communicates with inside portions of all the filters 105 through the filter inside bubble removing pipe 136. Further, the filter inside bubble removing pipe 136 is disposed in intimate contact with the upper end portion 105*a* of the filter 105 at which the bubble is concentrated through the suction opening. For this reason, the ink jet recording head 10 of this embodiment is capable of reliably removing the bubble collected to the upper end portion 105*a* of each of the filters 105 by the negative pressure generated by the rotation of the bubble suction tube pump 134.

Further, the communicating path is connected to a part of the filter 105, so that the bubble adhered to the filter surface can be collected to the upper end portion 105*a* of the inclined filter 105 by refilling during the recording. Further, also when a bubble present at a lower portion of the filter 105 is subjected to suction refreshing by actuating a negative pressure generating mechanism, the ink is supplied from the filter portion, so that air is not sucked from the ejection nozzle. For that reason, it is possible to carry out the refreshing operation with respect to the bubbles even during the recording.

Further, in order to remove the bubbles remaining in the nozzles, the openable valve 112 provided in the ink removing pipe 110 is opened while the tube pump 130 connected to the ink pressurizing pipe 108 with the tube 131 is rotated in a direction of an arrow C shown in FIG. 3. As a result, the inside pressure of the ink jet recording head 10 is changed to a positive pressure, so that the ink can be ejected from the ejection outlets and it is also possible to remove the bubbles remaining inside of the nozzles.

As described above, according to this embodiment, the filter 105 is provided in the inclined state with respect to the gravitational direction, so that the filter has a highest portion (the upper end portion 105*a*) with respect to the gravitational direction during the initial filling, the continuous recording operation and the refreshing operation. Further, at this portion, the filter inside bubble removing pipe 136 as a suction means for sucking the bubbles is provided, so that it is possible to remove the bubbles with reliability.

Second Embodiment

Figure 4:
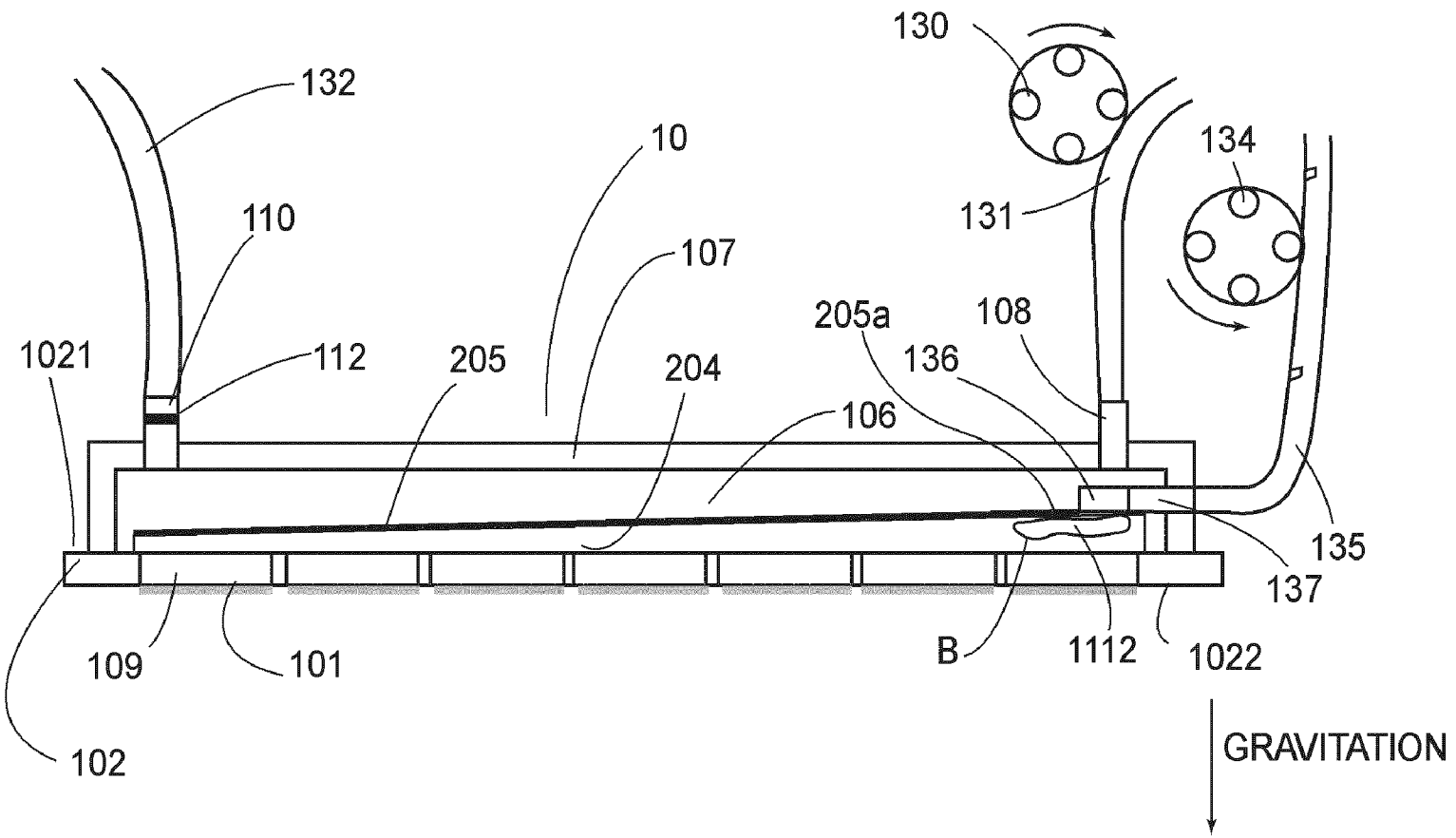

A schematic sectional view of an ink jet recording head of this embodiment is shown in FIG. 4. Constituents or means identical to those in First Embodiment are represented by reference numerals or symbols identical to those in First Embodiment and detailed description thereof will be omitted.

In this embodiment, a filter plate 204 disposed inside the ink jet recording head 10 is provided so as to communicate with all the common liquid chambers 109 disposed in parallel with each other. On the filter plate 204, a filter 205 is provided in an inclined state with respect to the gravitational direction. In First Embodiment, the filter plate 104 and the filter 105 are provided with respect to each of the ink jet head substrates 101. On the other hand, this embodiment is different from First Embodiment in that only one filter 205 for covering all the plurality of ink jet head substrates 101 is provided.

Also in this embodiment, similarly as in First Embodiment, bubbles can be collected to one position at an upper end portion 205*a*, so that it is possible to remove the bubbles present at an inside portion of the filter 205 with reliability.

According to this embodiment, the filter 205 has a highest portion (the upper end portion 205*a*) with respect to the gravitational direction during the refreshing operation for refreshing the ejection characteristic. Further, at this portion, the filter inside bubble removing pipe 136 as a suction means for sucking bubbles is provided, so that it is possible to remove the bubbles with reliability.

Third Embodiment

Figure 5:
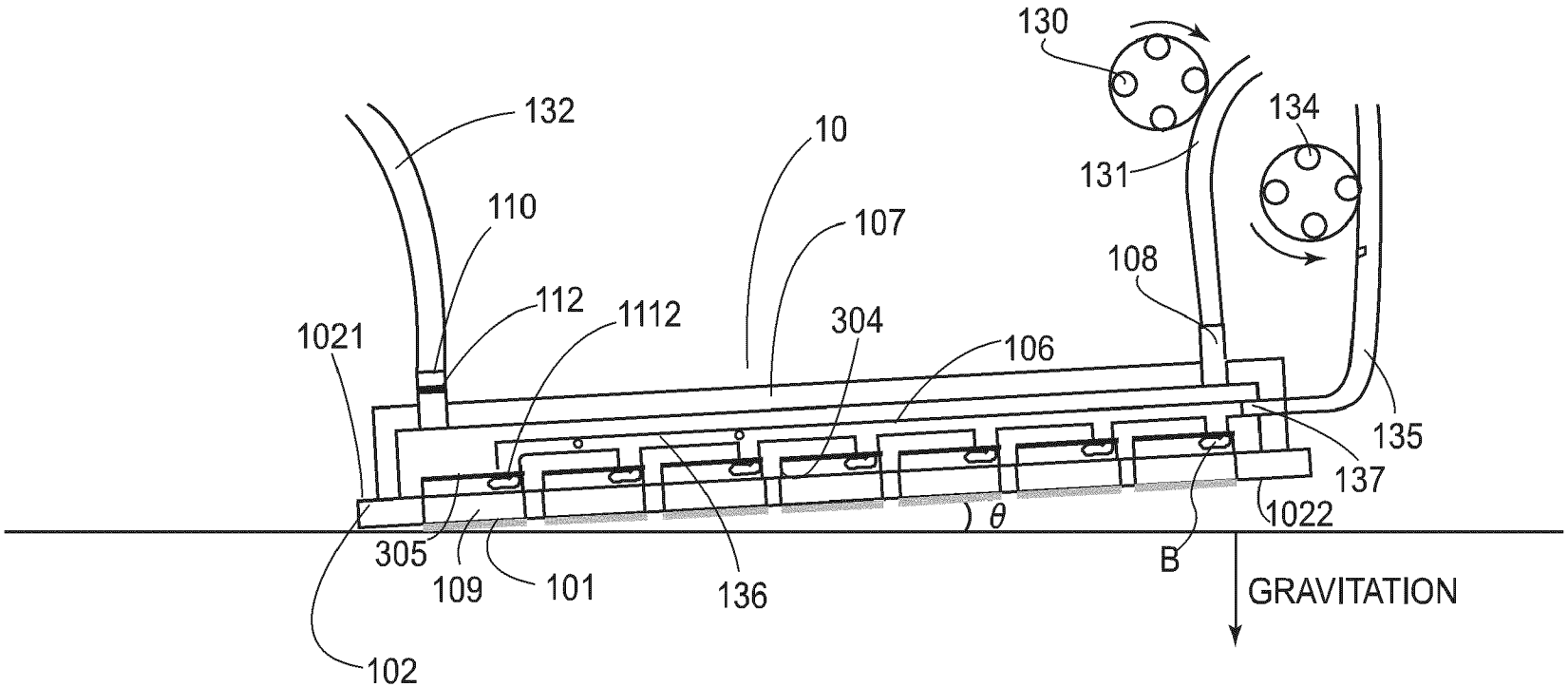

A schematic sectional view of an ink jet recording head of this embodiment is shown in FIG. 5. Constituents or means identical to those in First Embodiment are represented by reference numerals or symbols identical to those in First Embodiment and detailed description thereof will be omitted.

The ink jet recording head 10 of this embodiment is the same as that of First Embodiment except that filter plate 305 provided to filter plates 204 are disposed in parallel with the supporting substrate 102. The filter inside bubble removing pipe 136 is disposed at one end portion of each filter 305 similarly as in First Embodiment.

The ink jet recording apparatus of this embodiment includes an inclination means for inclining the ink jet recording head 10. The ink jet recording head 10 of this embodiment is inclined with respect to the gravitational direction during bubble removal by a driving means (not shown). That is, as shown in FIG. 5, the ink jet recording head 10 itself is inclined by an angle θ so that the side on which the filter inside bubble removing pipe 136 is disposed is an upper side with respect to the gravitational direction, with the result that bubbles are collected to a part (the side on which the filter inside bubble removing pipe 136 is disposed) of each filter 305.

Thus, in this embodiment, similarly as in First and Second Embodiments, bubbles can be collected to one position of each of the filter 305, so that it is possible to remove the bubbles present at an inside portion of the filters 305 with reliability.

According to this embodiment, each filter 305 has a highest portion with respect to the gravitational direction by inclining the ink jet recording head itself during the refreshing operation for refreshing the ejection characteristic. Further, at this portion, the filter inside bubble removing pipe 136 as a suction means for sucking bubbles is provided, so that it is possible to remove the bubbles with reliability.

Fourth Embodiment

Figure 6:
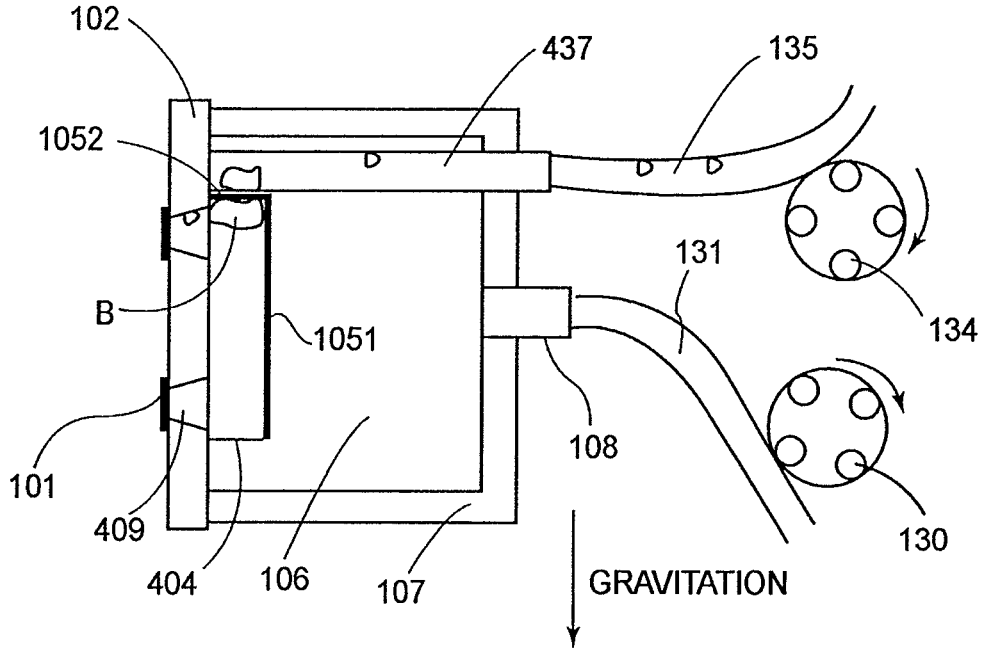
Figure 7:
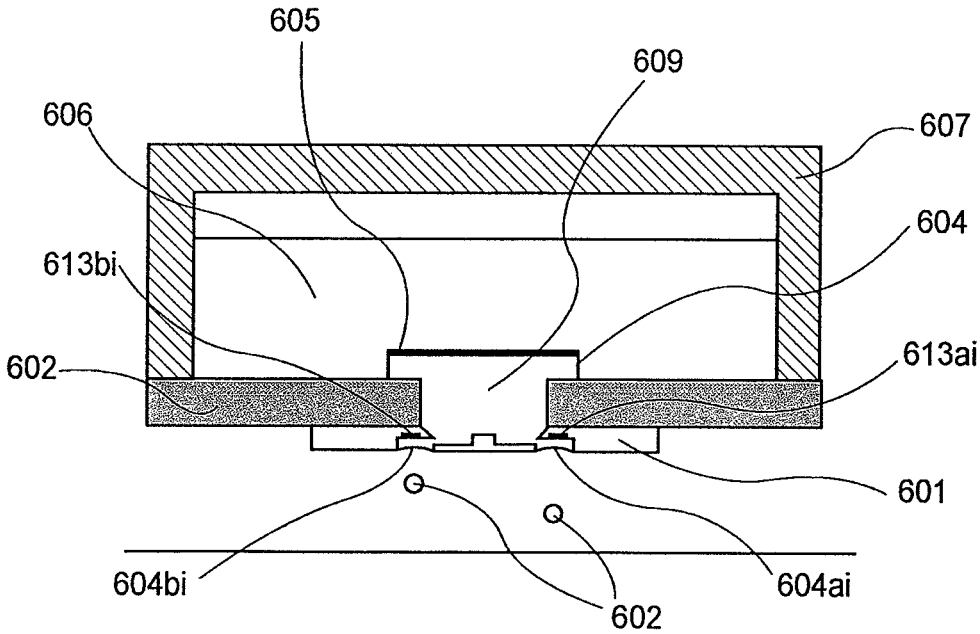
FIG.7 PRIOR ART
FIG. 7 is a schematic sectional view showing an embodiment of a conventional full-line type ink jet recording head.
Figure 8:
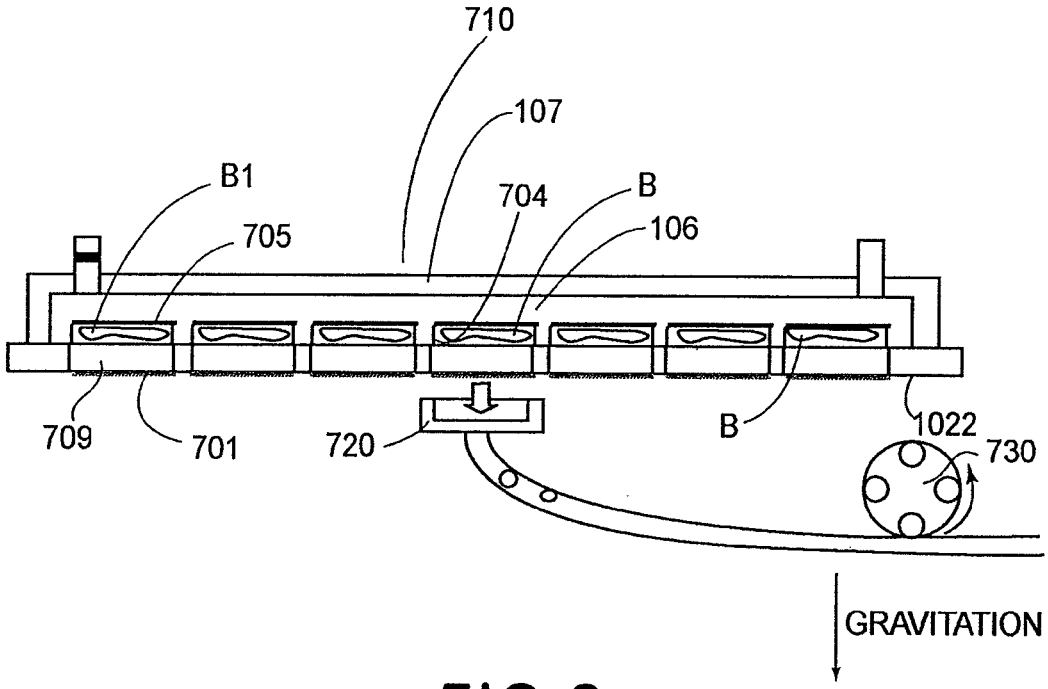
FIG.8 PRIOR ART
FIG. 8 is a schematic sectional view for illustrating a conventional suction refreshing operation of the full-line type ink jet recording head.
Figure 9:
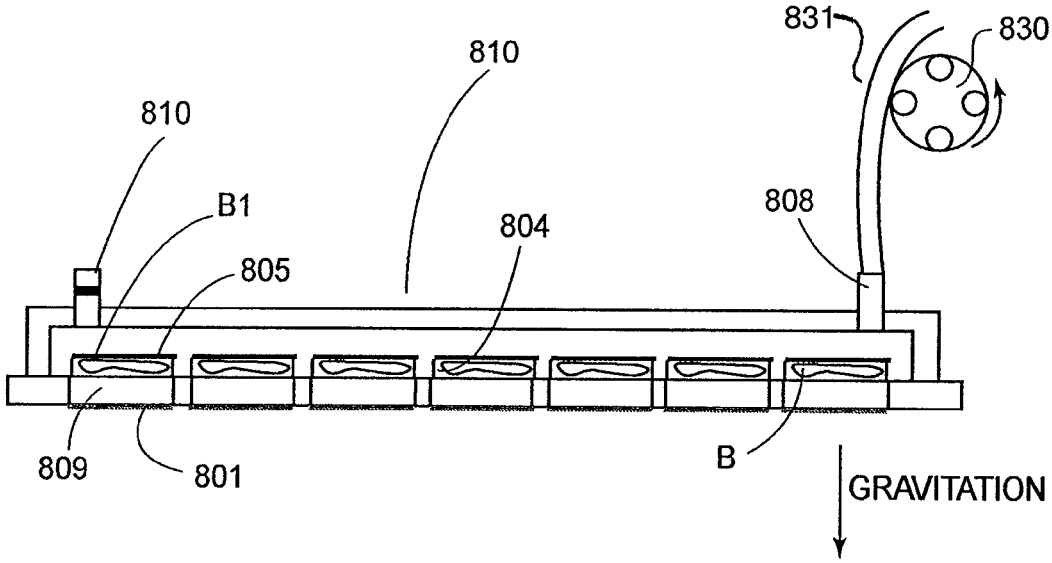
FIG.9 PRIOR ART
FIG. 9 is a schematic sectional view for illustrating a conventional pressurizing refreshing operation of the full-line type ink jet recording head.

A schematic sectional view of an ink jet recording head of this embodiment is shown in FIG. 6. Constituents or means identical to those in First Embodiment are represented by reference numerals or symbols identical to those in First Embodiment and detailed description thereof will be omitted.

FIG. 6 is a sectional view of a full-line type ink jet recording head, to which the present invention is applied, for ejecting ink in a (horizontal) direction perpendicular to the gravitational direction.

In this embodiment, at a side surface portion of a filter plate 404, an ink refilling filter 1051 is disposed. The ink refilling filter 1051 is provided in parallel with the gravitational direction and a bubble removing filter 1052 is provided above the ink refilling filter 1051 with respect to a direction perpendicular to the gravitational direction. A removing pipe connecting jig 437 is disposed in intimate contact with the bubble removing filter 1052. A common liquid chamber 409 in the supporting substrate 102 is tapered toward the ink jet recording head 101 so that generated bubbles can move to a position of the filter plate 404 by buoyancy of the bubbles.

The removing pipe connecting jig 437 is connected to a bubble suction tube 135 and a bubble B present inside the filter plate 404 can be removed by actuating a bubble suction tube pump 134 with respect to an arrow direction shown in FIG. 6.

In FIG. 6, similarly as in the constitution of Second Embodiment, the plurality of common liquid chambers is covered with the single filter but this embodiment is not limited thereto. It is also possible to employ such a constitution that filters are individually provided to each common liquid chamber.

In this embodiment, the full-line type ink jet recording apparatus for ejecting the ink in the horizontal direction is described but the present invention is also applicable to such an embodiment that recording is effected in an oblique direction with respect to the gravitational direction. By employing such a constitution, when bubbles stagnated inside the filter plate 404 are removed, the ink is supplied through the ink refilling filter 1051, so that the ejection characteristic can be refreshed without sucking air from ejection nozzles.

According to this embodiment, the filter has a highest portion (the bubble removing filter 1052) with respect to the gravitational direction during the refreshing operation for refreshing the ejection characteristic. Further, at this portion, the removing pipe connecting jig 437 as a suction means for sucking bubbles is provided, so that it is possible to remove the bubbles with reliability.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 218216/2007 filed Aug. 24, 2007, which is hereby incorporated by reference herein.

What is claimed is:

1. An ink jet recording head comprising:

a plurality of ink jet head substrates, each including ejection outlets for ejecting ink and energy generating elements for generating energy for ejecting the ink;

a supporting substrate for supporting said plurality of ink jet head substrates;

an ink accommodating portion, provided at a surface opposite from a surface of the supporting substrate which supports said plurality of ink jet head substrates, for accommodating the ink;

a plurality of filters provided in said ink accommodating portion so as to be inclined with respect to a gravitational direction when said ink jet recording head is used; and a plurality of suction openings through which the ink in regions between each of said filters and said supporting substrate is capable of being sucked via said filters, said suction openings being provided at the most elevated position of a surface of each of said filters; and a bubble removing pipe, provided in said ink accommodating portion, for communicating with each of said plurality of suction openings.

2. The head according to claim 1, wherein said filters are provided to in one to one correspondence with said ink jet head substrates.

3. The head according to claim 1, wherein said bubble removing pipe, an ink pressurizing pipe for supplying ink to said ink accommodating portion, and an ink removing pipe for removing ink in said ink accommodating portion are connected to said ink accommodating portion.

4. An ink jet recording apparatus comprising:

said ink jet recording according to claim 1; and means for inclining said ink jet recording head so that said plurality of filters are inclined with respect to the gravitational direction during a refreshing operation when said ink jet recording head is used.

* * * * *